US007580662B2

(12) United States Patent
Murayama

(10) Patent No.: US 7,580,662 B2
(45) Date of Patent: Aug. 25, 2009

(54) IMAGE FORMING APPARATUS WITH SENSING MEMBER THAT SENSES REFLECTION OF LIGHT RAYS FROM AN INTERMEDIATE TRANSFER BELT

(75) Inventor: Masato Murayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 206 days.

(21) Appl. No.: 11/626,806

(22) Filed: Jan. 24, 2007

(65) Prior Publication Data

US 2007/0172246 A1 Jul. 26, 2007

(30) Foreign Application Priority Data

Jan. 26, 2006 (JP) ..... 2006-018165

(51) Int. Cl.
*G03G 15/16* (2006.01)

(52) U.S. Cl. ..... 399/302; 399/308

(58) Field of Classification Search ..... 399/49, 399/302, 308
See application file for complete search history.

(56) References Cited

U.S. PATENT DOCUMENTS 5,745,831 A * 4/1998 Nakazawa et al. ..... 399/308
6,212,350 B1 * 4/2001 Yamada et al. ..... 399/302
6,341,205 B1 * 1/2002 Yoshino et al. ..... 399/101
6,393,226 B1 * 5/2002 Charlebois et al. ..... 399/12
7,409,171 B2 * 8/2008 Maeda et al. ..... 399/50
2005/0100806 A1 * 5/2005 Hongo et al. ..... 430/78
2007/0172748 A1 * 7/2007 Inoue et al. ..... 430/45.56

FOREIGN PATENT DOCUMENTS

JP 2004070191 A * 3/2004
JP 2004-354932 12/2004

* cited by examiner

*Primary Examiner*—Quana M Grainger
(74) *Attorney, Agent, or Firm*—Hogan & Hartson LLP

(57) ABSTRACT

An image forming apparatus includes an intermediate transfer belt having a coated layer as a surface layer that carries an developer image on the surface layer, a light-emitting member that emits light rays having a predetermined wavelength toward the surface layer of the intermediate transfer belt, and a sensing member that senses the light rays reflected from the intermediate transfer belt. The intermediate transfer belt includes a metal layer whose light reflection coefficient is larger than that of the coated layer and an intermediate layer positioned between the coated layer and the metal layer, and the intermediate layer that restrains the different light rays having a wavelength other than the predetermined wavelength from reflecting from the intermediate transfer belt.

3 Claims, 7 Drawing Sheets

IMAGE FORMING APPARATUS WITH SENSING MEMBER THAT SENSES REFLECTION OF LIGHT RAYS FROM AN INTERMEDIATE TRANSFER BELT

BACKGROUND

1. Technical Field

The present invention relates to an image forming apparatus and image forming system.

2. Related Art

An image forming apparatus such as a laser beam printer is already well known. There is an image forming apparatus including an intermediate transfer belt for carrying a developer image, a light-emitting member that emits light rays having a predetermined wavelength toward a surface layer of the intermediate transfer belt and a sensing member that senses the light rays reflected from the intermediate transfer belt.

There might be various objects for providing the light-emitting member and the sensing member as described above in the image forming apparatus. As an example, there is a case in which these members are provided for detecting the density of developer image carried on the intermediate transfer belt for adjusting the density of the image.

In such a case, a patch image (test pattern) as the developer image is developed when executing a control operation for controlling the density of the image, and the patch image is transferred to the intermediate transfer belt. Then, a light ray is emitted from the light-emitting member toward the intermediate transfer belt to which the patch image is transferred, and the emitted light ray (that is, incident light ray) is reflected from the intermediate transfer belt. Then, the reflected light rays are sensed by the sensing member, and the density of the patch image is detected on the basis of the detection result.

There is the intermediate transfer belt described above, which includes a metal layer and a surface layer which is a layer coated on the metal layer. As the intermediate transfer belt of this type, the intermediate transfer belt having a three-layer structure in which the metal layer is deposited on a base layer as a back layer, and the coated layer as the surface layer is coated on the metal layer is well known. Since the metal layer includes metal, the light reflection coefficient of the metal layer is larger than that of the coated layer. Therefore, when the light rays are emitted from the light-emitting member toward the intermediate transfer belt of this type, the light rays mainly pass through the coated layer and reflected from the metal layer.

In the image forming apparatus, different light rays having a wavelength different from the wavelength of the light rays emitted from the above-described light-emitting member (hereinafter, referred to as "different light rays" may be irradiated on the intermediate transfer belt. For example, as an example of the different light rays, there are light rays emitted from a component in the image forming apparatus, or light rays emitted from a fluorescent lamp provided in a room where the image forming apparatus is placed. When the light rays are emitted from the light-emitting member, and the reflected light rays thereof are sensed by the sensing member for the purpose of detecting the density of the developer image, the above-described reflected light rays of the different light rays reflected from the intermediate transfer belt (metal layer) are also received by the sensing member. Therefore, there is a problem that the different light rays received by the sensing member become noises, which results in deterioration of the sensing accuracy of the sensing member (that is, the sensing accuracy when sensing the light rays emitted from the light-receiving member).

SUMMARY

An advantage of some aspects of the invention is to improve the detection accuracy of a sensing member.

According to a main aspect of the invention, there is provided an image forming apparatus including an intermediate transfer belt having a coated layer as a surface layer that carries an developer image on the surface layer, a light-emitting member that emits light rays having a predetermined wavelength toward the surface layer of the intermediate transfer belt and a sensing member that senses the light rays reflected from the intermediate transfer belt, wherein the intermediate transfer belt includes a metal layer whose light reflection coefficient is larger than that of the coated layer, and an intermediate layer positioned between the coated layer and the metal layer for restraining the different light rays having a wavelength other than the predetermined wavelength from reflecting from the intermediate transfer belt.

Other characteristics of the invention will become more apparent from the following description of the specification and the appended drawings.

Description of the specification and the appended drawings given below will make aspects of the invention apparent as follows.

According to an aspect of the invention, there is provided an image forming apparatus including an intermediate transfer belt having a coated layer as a surface layer that carries an developer image on the surface layer, a light-emitting member that emits light rays having a predetermined wavelength toward the surface layer of the intermediate transfer belt, and a sensing member that senses the light rays reflected from the intermediate transfer belt, wherein the intermediate transfer belt includes a metal layer whose light reflection coefficient is larger than that of the coated layer and an intermediate layer positioned between the coated layer and the metal layer for restraining the different light rays having a wavelength other than the predetermined wavelength from reflecting from the intermediate transfer belt.

According to the image forming apparatus as shown above, the sensing accuracy of the sensing member can be improved.

The intermediate transfer belt may include a base layer on the side opposite from the intermediate layer when viewed from the metal layer.

The intermediate layer may include a plurality of layers for restraining the different light rays of a plurality of types having different wavelengths from each other from reflecting from the intermediate transfer belt.

In this case, the sensing accuracy of the sensing member can be improved more appropriately.

The sensing member may sense the light rays reflected from the intermediate transfer belt and detect the density of the developer image carried on the intermediate transfer belt.

In this case, the accuracy for detecting the density of the developer image can be improved.

There may be provided a controller that controls the density of the image on the basis of the result of detection of the density of the developer image by the sensing member. In this case, the density of the image can be adjusted with high degree of accuracy.

There is provided an image forming apparatus including an intermediate transfer belt having a coated layer as a surface layer that carries an developer image on the surface layer, a light-emitting member that emits light rays having a predetermined wavelength toward the surface layer of the intermediate transfer belt, and a sensing member that senses the light rays reflected from the intermediate transfer belt wherein the intermediate transfer belt includes a metal layer whose light reflection coefficient is larger than that of the coated layer and an intermediate layer positioned between the coated layer and the metal layer for restraining the different light rays having a wavelength other than the predetermined wavelength from reflecting from the intermediate transfer belt, the intermediate transfer belt includes a basic layer on the side opposite from the intermediate layer when viewed from the metal layer, the intermediate layer includes a plurality of layers for restraining the different light rays of a plurality of types having different wavelengths from each other from reflecting from the intermediate transfer belt, the sensing member senses the light rays reflected from the intermediate transfer belt and detects the density of the developer image carried on the intermediate transfer belt, and there is provided a controller that controls the density of the image on the basis of the result of detection of the density of the developer image by the sensing member.

In this arrangement, all the effects described above are achieved, and hence the object of the invention is effectively achieved.

There is provided an image forming system including a computer and an image forming apparatus which is connectable to the computer, the image forming apparatus including an intermediate transfer belt having a coated layer as a surface layer that carries an developer image on the surface layer, a light-emitting member that emits light rays having a predetermined wavelength toward the surface layer of the intermediate transfer belt, and a sensing member that senses the light rays reflected from the intermediate transfer belt, wherein the intermediate transfer belt includes a metal layer whose light reflection coefficient is larger than that of the coated layer and an intermediate layer positioned between the coated layer and the metal layer for restraining the different light rays having a wavelength other than the predetermined wavelength from reflecting from the intermediate transfer belt.

In this image forming system, the sensing accuracy of the sensing member can be improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Entire Configuration of Image Forming Apparatus

Figure 1:
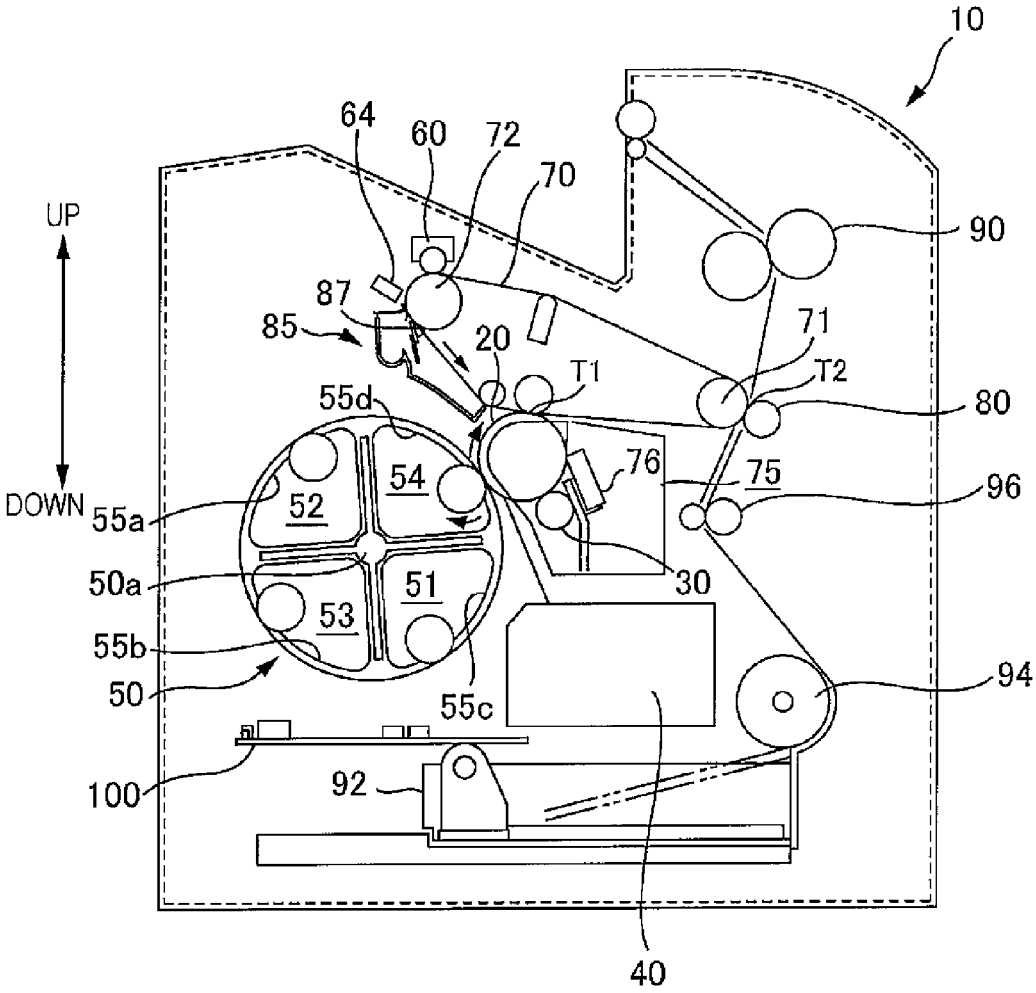
FIG. 1 is a drawing showing main components which constitute a printer 10.

Referring now to FIG. 1, a general configuration of an image forming apparatus will be described with a laser beam printer (hereinafter referred to also as "printer") 10 as an example. FIG. 1 is a drawing showing main components which constitute the printer 10. In FIG. 1, upper and lower directions (vertical direction) are indicated by an arrow, and a paper feed tray 92 is arranged in a lower portion of the printer 10 and a fixing unit 90 is arranged on an upper portion of the printer 10.

As shown in FIG. 1, the printer 10 according to this embodiment includes a charging unit 30, an exposure unit 40, an YMCK developing unit 50, an intermediate transfer belt 70, and a photoreceptor cleaning unit 75 along the direction of rotation of a photoreceptor 20, and further includes a primary transfer unit 60, a secondary transfer unit 80, an intermediate transfer belt cleaning unit 85, a fixing unit 90, a display unit 95 (FIG. 3) which serves as an informing device for users and formed of a liquid crystal panel and a control unit 100 that controls the units and manages the operation of the same as a printer.

The photoreceptor 20 includes a cylindrical conductive base material and a photosensitive layer formed on the outer peripheral surface thereof, and is rotatably about the center axis. In this embodiment, it rotates clockwise as indicated by an arrow in FIG. 1.

The charging unit 30 is a device that charges the photoreceptor 20, and the exposure unit 40 is a device that forms a latent image on the photoreceptor 20 charged by irradiating a laser. The exposure unit 40 includes a semiconductor laser, a polygon mirror, an F-θ lens, and irradiates a modulated laser to the charged photoreceptor 20 on the basis of the image signals supplied from a host computer, not shown, such as a personal computer or a word processor.

The YMCK developing unit 50 is a device for developing the latent image formed on the photoreceptor 20 with toner as an example of the developer stored in the developing device, that is, black (K) toner stored in a black developing device 51, magenta (M) toner stored in a magenta developing device 52, cyan (C) toner stored in a cyan developing device 53 and yellow (Y) toner stored in a yellow developing device 54.

The YMCK developing unit 50 can move the positions of the four developing devices 51, 52, 53 and 54 by being rotated in a state in which the four developing devices 51, 52, 53 and 54 are mounted. That is, the YMCK developing unit 50 holds the four developing devices 51, 52, 53 and 54 by holding portions 55*a*, 55*b*, 55*c* and 55*d*, and the four developing units 51, 52, 53 and 54 are rotatable about a center axis 50*a* while maintaining the relative position thereof. Then, every time when the image formation for one page is finished, the YMCK developing unit 50 selectively opposes the photoreceptor 20 and develops the latent images formed on the photoreceptor 20 in sequence by the toners stored in the respective developing devices 51, 52, 53 and 54. The four developing devices 51, 52, 53 and 54 described above are respectively detachably attached to the main body of the image forming apparatus, more specifically, the holding portions 55*a*, 55*b*, 55*c* and 55*d* of the YMCK developing unit 50.

The intermediate transfer belt 70 is an intermediate medium used when transferring a toner image as an example of the developer image on the photoreceptor 20 to a recording material (paper, film, cloth, etc.), which rotates in a state of carrying the toner (toner image) to move the toner (toner image) for transferring the toner (toner image) to the recording material. The intermediate transfer belt 70 is an endless belt wound around a drive roller 71 and a driven roller 72 so as to extend therebetween in a tightened state, and is driven to rotate substantially at the same peripheral velocity as the photoreceptor 20. The structure of the intermediate transfer belt 70 will be described later in detail.

A patch sensor 64 which has a function as the density detecting member that detects the density of the toner image on the intermediate transfer belt 70 is provided in the vicinity of the intermediate transfer belt 70. The printer 10 executes the controlling operation that controls the density of the image at a predetermined timing and, at this time, the patch sensor 64 is used. That is, when the controlling operation is executed, a patch image (test pattern) as the toner image is developed, and the patch image is transferred to the intermediate transfer belt 70. Then, the density of the patch image transferred to the intermediate transfer belt 70 is detected by the patch sensor 64, and the density of the image is adjusted on the basis of the density of the detected patch image. The patch sensor 64 will be described later.

The primary transfer unit 60 is a device that transfers a mono-color toner image formed on the photoreceptor 20 to the intermediate transfer belt 70, and when the toners in four colors are transferred in a superimposed manner in sequence, a full-color image is formed on the intermediate transfer belt 70. The primary transfer unit 60 comes into contact with the intermediate transfer belt 70 above the driven roller 72 to apply a primary transfer voltage to the intermediate transfer belt 70. Although detailed description is given later, the intermediate transfer belt 70 has a metal layer 412 (FIG. 4), so that the primary transfer voltage having an opposite polarity from the polarity of the charged toner (negative in this embodiment) is applied to the metal layer 412 by the primary transfer unit 60. When the primary transfer voltage is applied to the metal layer 412, an electric field is formed between the photoreceptor 20 and the intermediate transfer belt 70 (metal layer 412) at a primary transfer position T1, whereby the mono-color toner image formed on the photoreceptor 20 is transferred to the intermediate transfer belt 70.

The photoreceptor cleaning unit 75 is a device provided above the exposure unit 40 and has a photoreceptor cleaning blade 76 formed of rubber which is in abutment with the surface of the photoreceptor 20 for scraping off and collecting the toner remaining on the photoreceptor 20 by photoreceptor cleaning blade 76 after the toner image is transferred to the intermediate transfer belt 70 by the primary transfer unit 60.

The secondary transfer unit 80 is a device that transfers the mono-color toner image or the full-color toner image formed on the intermediate transfer belt 70 to the recording material.

The intermediate transfer belt cleaning unit 85 is a device provided above the YMCK developing unit 50 for collecting the toner which is not transferred to the recording material and remains on the intermediate transfer belt 70. The intermediate transfer belt cleaning unit 85 has a cleaning blade 87 formed of rubber which is in abutment with the surface of the intermediate transfer belt 70 for scraping off and collecting a toner T remaining on the intermediate transfer belt 70 by the cleaning blade 87 after the toner image is transferred to the recording material by the secondary transfer unit 80. The control unit 90 is a device that causes the mono-color toner image and the full-color toner image transferred to the recording material to be fusion-bonded to the recording material.

Figure 3:
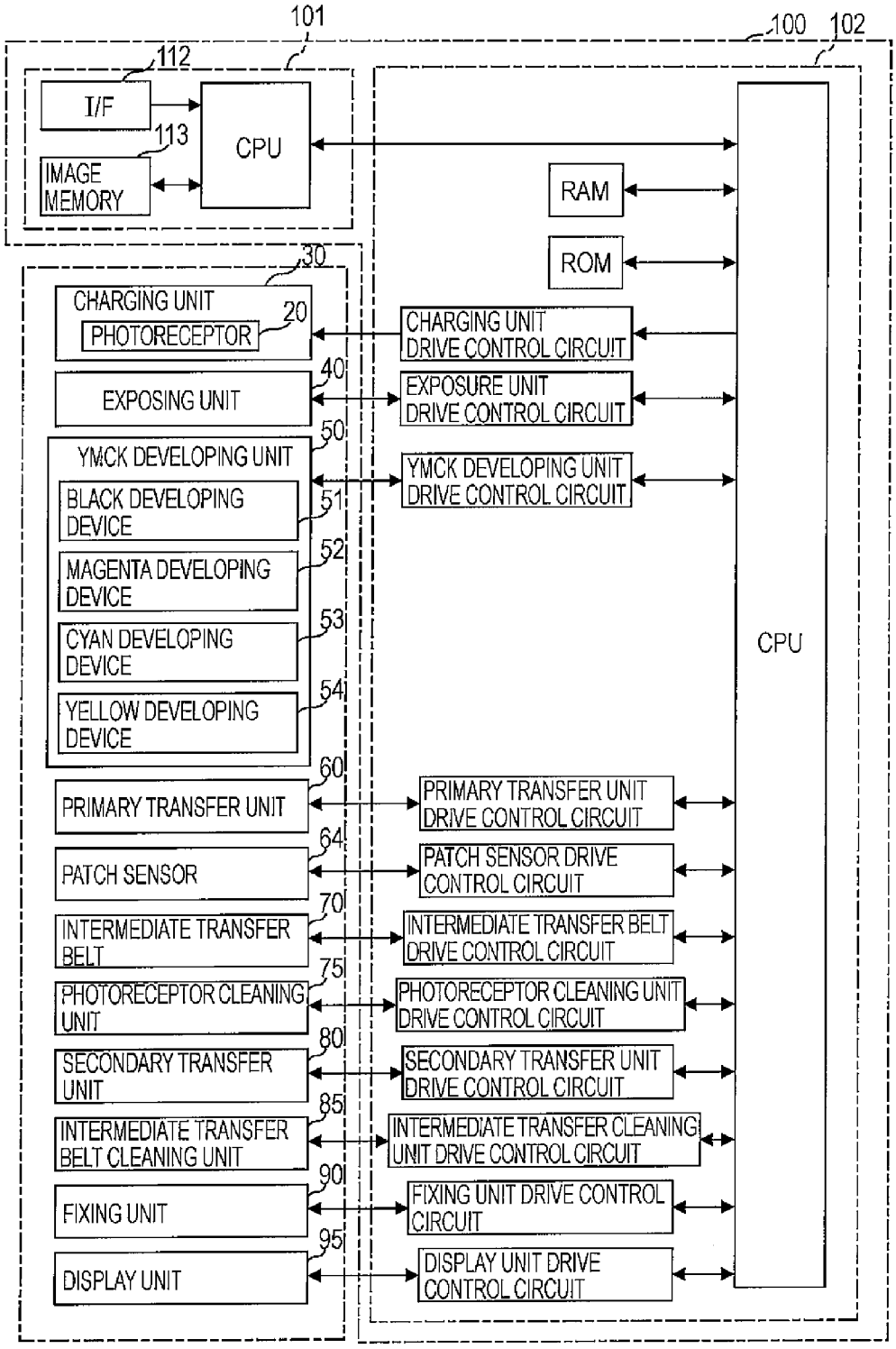
FIG. 3 is a block diagram showing a control unit of the printer 10 in FIG. 1.

The control unit 100 includes a main controller 101 and a unit controller 102, as shown in FIG. 3. The main controller 101 is supplied with image signals and control signals, so that the unit controller 102 controls the respective units and forms images according the command on the basis of the image signal and the control signal.

Subsequently, the image forming operation of the printer 10 configured as described above will be described.

Firstly, when the image signal and the control signal is supplied from the host computer, not shown, to the main controller 101 of the printer 10 via an interface (I/F) 112, the photoreceptor 20 and the intermediate transfer belt 70 rotate under the control of the unit controller 102 on the basis of a command from the main controller 102. The photoreceptor 20 is charged in sequence by the charging unit 30 at charging positions while being rotated.

The charged area of the photoreceptor 20 reaches the exposure position in association with the rotation of the photoreceptor 20, and a latent image according to the image information of a first color, for example, yellow Y is formed on that area by the exposure unit 40. The YMCK developing unit 50 is positioned in such a manner that the yellow developing device 54 which stores the yellow (Y) toner is positioned at a developing position opposing the photoreceptor 20.

The latent image formed on the photoreceptor 20 reaches the developing position in association with the rotation of the photoreceptor 20, and is developed by the yellow developing device 54 with the yellow toner. That is, the yellow developing device 54 visualizes the latent image carried on the photoreceptor 20 with the toner as the toner image. Accordingly, the yellow toner image is formed on the photoreceptor 20.

The yellow toner image formed on the photoreceptor 20 reaches the primary transfer position T1 in association with the rotation of the photoreceptor 20, and is transferred on the intermediate transfer belt 70. At this time, the primary transfer voltage is applied to the intermediate transfer belt 70 by the primary transfer unit 60. During this process, the photoreceptor 20 and the intermediate transfer belt 70 are still in contact, and the secondary transfer unit 80 is apart from the intermediate transfer belt 70.

The process described above are executed for the respective developing devices for second color, third color, and fourth color in sequence, so that the toner images in four colors corresponding to the respective image signals are transferred to the intermediate transfer belt 70 in a superimposed state. Accordingly, the full color toner image is formed on the intermediate transfer belt 70.

The full color toner image formed on the intermediate transfer belt 70 reaches a second rotating position T2 in association with the rotation of the intermediate transfer belt 70, and is transferred to the recording material by the secondary transfer unit 80. The recording material is transferred from the paper feed tray 92 to the secondary transfer unit 80 via a paper feed roller 94, and a resist roller 96. When performing the transfer operation, the secondary transfer unit 80 is pressed against the intermediate transfer belt 70, and a secondary transfer voltage is applied to the secondary transfer unit 80. The toner which is not transferred to the recording material and remaining on the intermediate transfer belt 70 is collected by the intermediate transfer belt cleaning unit 85.

The full color toner image transferred to the recording material is heated and pressurized by the fixing unit 90 and fusion-bonded to the recording material.

On the other hand, the toner attached on the surface of the photoreceptor 20 is collected by the photoreceptor cleaning unit 75 after having passed over the primary transfer position T1, so that the photoreceptor 20 is ready for the charge for forming the next latent image.

Patch Sensor 64

Figure 2:
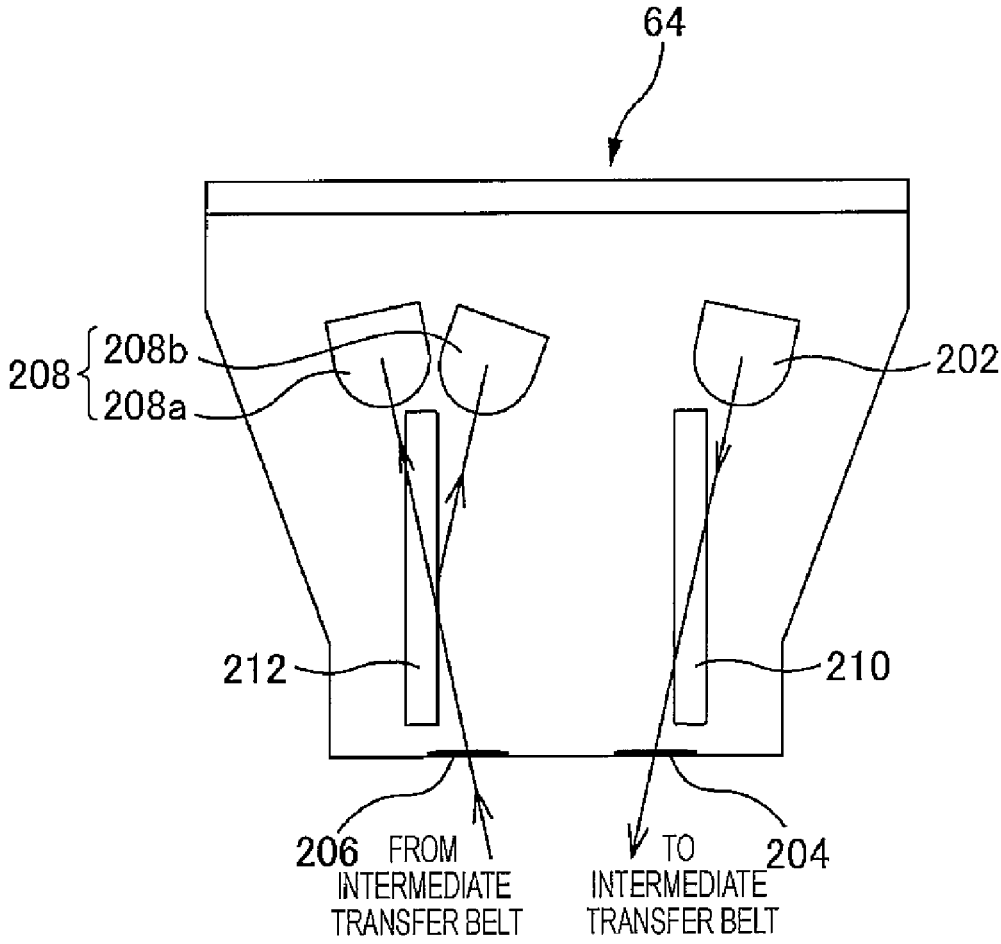
FIG. 2 is a pattern diagram showing a patch sensor 64.

Referring now to FIG. 2, the patch sensor 64 will be described in further detail. FIG. 2 is a pattern diagram showing the patch sensor 64.

The patch sensor 64 is a reflection optical sensor that detects the density of the above-described patch image on the intermediate transfer belt 70. The patch sensor 64 includes a light-emitting member 202 that emits a light ray having a predetermined wavelength (in this embodiment, it is infrared ray and the wavelength thereof is about 850 nm) toward a surface layer 414 (FIG. 4) of the intermediate transfer belt 70, a light-emitting side window 204 that allows passage of the light rays toward the intermediate transfer belt 70, that is, incident light, a light-receiving side window 206 that allows passage of the light rays reflected from the intermediate transfer belt 70, that is, reflected light rays, and a sensing member 208 that senses reflected light rays upon reception of the reflected light rays passed through the light receiving side window 206. The incident light emitted from the light-emitting member 202 toward the intermediate transfer belt 70 (the incident light enters the intermediate transfer belt 70 substantially at a right angle) passes through the light-emitting side window 206 and is reflected from the intermediate transfer belt 70. Then, the reflected light rays is sensed by the sensing member 208 after having passed through the light-emitting side window 204, and is converted to the electric signal. Since there is a certain relation between the density of the patch image and the intensity of the detected reflected light rays, the density of the patch image is detected on the basis of the magnitude of the electric signal. That is, the sensing member 208 senses the reflected light rays and detects the density of the toner image (patch image) carried by the intermediate transfer belt 70.

The patch sensor 64 according to this embodiment includes a light-receiving side polarizing beam splitter 212 between the sensing member 208 and a light-receiving side window 206, and a light-receiving side polarizing beam splitter 210 between the light-emitting member 202 and the light-emitting side window 204, respectively. The light-receiving side polarizing beam splitter 212 split the reflected light rays into so called a p-polarized component and an s-polarized component. The patch sensor 64 in this embodiment, includes the two sensing members, that is, a p-polarized component sensing member 208*a* that senses the p-polarized component and an s-polarized component sensing member 208*b* that senses the s-polarized components as the sensing members, and the p-polarized component sensing member 208*a* senses the p-polarized component and the s-polarized component sensing member 208*b* senses the s-polarized component, respectively. Then, a predetermined calculation is performed using the intensity of the p-polarized component and the s-polarized component sensed by the respective sensing members (that is, the magnitude of the electric signal), so that the density of the patch image is obtained. The light-receiving side polarizing beam splitter 210 serves to cause only the p-polarized component from the group of the p-polarized component and the s-polarized component of the incident light to proceed toward the intermediate transfer belt 70.

Brief Description of Control Unit

Referring now to FIG. 3, a configuration of the control unit 100 will be described. The main controller 101 of the control unit 100 includes an image main memory 113 connected to the host computer via the interface 112 that stores the image signals supplied from the host computer. The unit controller 102, being electrically connected to the respective units of the apparatus body (the charging unit 30, the exposure unit 40, the YMCK developing unit 50, the primary transfer unit 60, the patch sensor 64, the intermediate transfer belt 70, the photoreceptor cleaning unit 75, the secondary transfer unit 80, the intermediate transfer belt cleaning unit 85, the fixing unit 90, the display unit 95), detects the states of the respective units by receiving the signals from the sensors provided therein, and controls the respective units on the basis of the signals supplied from the main controller 101. For example, the unit controller 102 adjusts the density of the image by changing the developing bias applied to the developing device in the YMCK development unit 50 on the basis of the result sensed by the sensing member 208 of the patch sensor 64 relating to the density of the toner image (patch image).

Structure of Intermediate Transfer Belt 70

Figure 4:
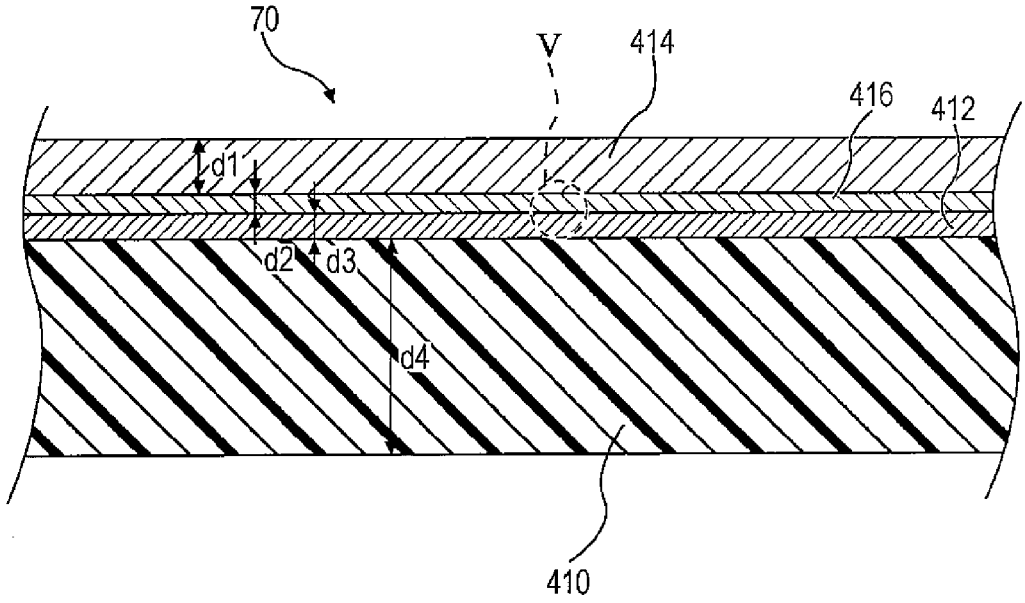
FIG. 4 is a pattern diagram for explaining a structure of an intermediate transfer belt 70.

Referring now to FIG. 4, an example of a structure of the intermediate transfer belt 70 will be described. FIG. 4 is a pattern diagram for explaining the structure of the intermediate transfer belt 70.

In this embodiment, the intermediate transfer belt 70 has a structure having four layers, that is, a surface layer 414, an intermediate layer 416, the metal layer 412 and a base layer 410.

The surface layer 414 is a layer positioned on the front side of the intermediate transfer belt 70 and carries the toner image. The front layer 414 is a (semi) conductive coated layer coated on the intermediate layer 416 described later, whose thickness d1 is about 20 μm. The coated layer includes resin and non-colloidal metal particles (tin oxide in this embodiment). The resin includes Teflon® of about 0.1 μm in particle diameter and water-soluble urethane, and the particle diameter of the metal particle is larger than 1 μm.

The intermediate layer 416 is a layer positioned between the front layer (coated layer) 414 and the metal layer 412 described later. The function and configuration of the intermediate layer 416 will be described later.

The metal layer 412 is a layer positioned between the intermediate layer 416 and the base layer 410 described later. The metal layer 412 is a metal (tin) deposited layer formed by depositing the metal (tin, in this embodiment) to the base layer 410, whose thickness d3 is equal to or smaller than 1 μm.

The basic layer 410 is a (back) layer positioned on the opposite side from the intermediate layer 416 viewed from the metal layer 412, and on the back side of the intermediate transfer belt 70 (that is, the side which the drive roller 71 or the driven roller 72 come into contact with). The base layer 410 is formed of PET film, and the thickness d4 thereof is about 100 μm.

Intermediate Layer 416

As described above, the image forming device may include the intermediate transfer belt that carries the toner image, the light-emitting member that emits the light rays having the predetermined wavelength toward the surface layer of the intermediate transfer belt and the sensing member that senses the light rays reflected from the intermediate transfer belt.

The intermediate transfer belt may include the metal layer and the coated layer coated on the metal layer. As the intermediate transfer belt of this type, the intermediate transfer belt having the three-layer structure in which the metal layer is deposited on the base layer as the back layer and the coated layer as the surface layer is coated on the metal layer is well known. Since the metal layer includes metal, the light reflection coefficient of the metal layer is larger than that of the coated layer. Therefore, when the light rays from the light-emitting member is emitted toward the intermediate transfer belt, the light ray passes through the coated layer and is reflected mainly by the metal layer.

Then, the image forming apparatus provided with the intermediate transfer belt in this configuration has following problem. That is, in the image forming apparatus, different light rays having a wavelength different from the wavelength of the light rays emitted from the light-emitting member may be irradiated on the intermediate transfer belt. For example, as an example of the different light rays, there are light rays emitted from a component in the image forming apparatus, or light rays emitted from a fluorescent lamp provided in a room where the image forming apparatus is placed. When the light rays are emitted from the light-emitting member for the purpose of detecting the density of the toner image and the reflected light rays thereof are sensed by the sensing member, the above-described reflected light rays of the different light rays reflected from the intermediate transfer belt (metal layer) are also received by the sensing member. Therefore, there is a problem such that the different light rays received by the sensing member become noises, which results in deterioration of the sensing accuracy of the sensing member (that is, the sensing accuracy when sensing the light rays emitted from the light-receiving member).

In contrast, since the intermediate transfer belt 70 provided in the image forming apparatus according to this embodiment includes the fourth layer (that is, the intermediate layer 416) for restraining the reflection of the different light rays which might be a source of the noise from intermediate transfer belt 70 is provided in addition to the three-layers that the above-described known intermediate transfer belt has, that is, the base layer 410, the metal layer 412 and the surface layer (coated layer) 414, when the sensing member 208 senses the reflected light rays of the light rays emitted from the light-emitting member 202 and reflected by the intermediate transfer belt 70 (metal layer 412), the noise is reduced and the sensing accuracy of the sensing member 208 is improved.

Figure 5:
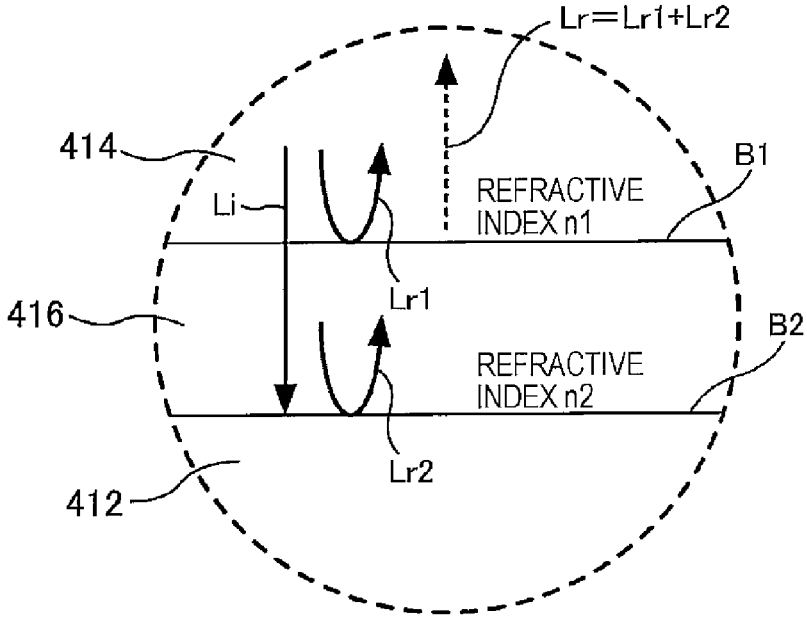
FIG. 5 is a pattern diagram showing a state in which different light rays are reflected by the intermediate transfer belt 70 provided with an intermediate layer 416.

Referring now to FIG. 5, the configuration of the intermediate layer 416 which can demonstrate the function to restrain the reflection of the different light rays from the intermediate transfer belt 70 will be described below, and subsequently, an example of the intermediate layer 416 will be given.

The wavelength of the different light rays which are desired to be restrained from being reflected is represented by λ. The wavelength λ is naturally different from the wavelength of the light rays emitted from the light-emitting member 202 and, for example, it is desirable to be the wavelength of the light rays emitted from the components in the image forming apparatus or the wavelength of the light emitted from the fluorescent lamp.

FIG. 5 shows a state in which the different light rays having the wavelength λ are reflected from the intermediate transfer belt 70 having the intermediate layer 416. FIG. 5 illustrates a portion surrounded by a circle indicated by a broken line in FIG. 4.

When certain different light rays proceed to the intermediate transfer belt 70, the different light rays in question enter the intermediate transfer belt 70 (the incident light is indicated by reference sign Li in FIG. 5). Subsequently, the different light rays pass through the front layer (coated layer) 414 having a low light reflection coefficient, and reaches a boundary B1 between the surface layer (coated layer) 414 and the intermediate layer 416. Part of the different light rays (represented by reference sign Lr1 in FIG. 5) are reflected at the boundary B1, and the other part (represented by reference sign Lr2 in FIG. 5) are reflected at the boundary B2 between the intermediate layer 416 and the metal layer 412 after having passed through the intermediate layer 416. Here, when the relational expression $2\times(n2/n1)\times d2=\lambda/2$ is established, where n1 represents a refractive index of the surface layer (coated layer) 414, n2 represents a refractive index of the intermediate layer 416, and d2 represents the thickness of the intermediate layer 416 (see FIG. 4), the phase of the different light rays Lr1 reflected from the boundary B1 and the phase of the other lights Lr2 reflected at the boundary B2 are inverted in the surface layer (coated layer) 414, and the reflected light rays Lr (=Lr1+Lr2) are extremely damped due to the interference with respect to each other. Therefore, by setting the thickness d2 of the intermediate layer 416 to be equal to $(\lambda/2)/(2\times(n2/n1))$, the intermediate layer 416 can demonstrate the function to restrain the reflection of the different light rays having the wavelength λ by the intermediate transfer belt 70. Since the thickness d2 of the intermediate layer 416 needs to be controlled adequately, it is preferable to form the intermediate layer 416 not by coating, but by depositing (by depositing substance that forms the intermediate layer 416 to the metal layer 412) in terms of easiness of the control of the thickness.

Although any substance may be employed as the substance that forms the intermediate layer 416, it is necessary to consider that there exist substances that do not allow passage of the different light rays having the wavelength λ. That is, in order to damp the reflected light rays Lr, as described above, (the part of) the different light rays having the wavelength λ should pass through the intermediate layer 416. Therefore, it is necessary to form the intermediate layer 416 of a substance which allows passage of the light rays having the wavelength λ.

Subsequently, the intermediate layer 416 will be described with a detailed example. In the following description, it is assumed that the different light rays which are desired to be restricted from reflecting are visible light and have a wavelength λ of 800 nm. The refractive index n1 of the surface layer (coated layer) 414 is assumed to be 1.56.

As the detailed example, the intermediate layer 416 formed of antimony trisulfide (Sb2S3) may be exemplified. Since the antimony trisulfide (Sb2S3) allows passage of light rays having the wavelength λ from 500 nm to 10000 nm, it is suitable as the substance for forming the intermediate layer 416. The refractive index of the antimony trisulfide (Sb2S3) is 3.0, if the thickness d2 of the intermediate layer 416 is $(800/2)/(2\times(3.0/1.56))=104$ nm, the intermediate layer 416 can demonstrate the function to restrain the reflection of the different light rays having the wavelength λ from the intermediate transfer belt 70 adequately.

Figure 6:
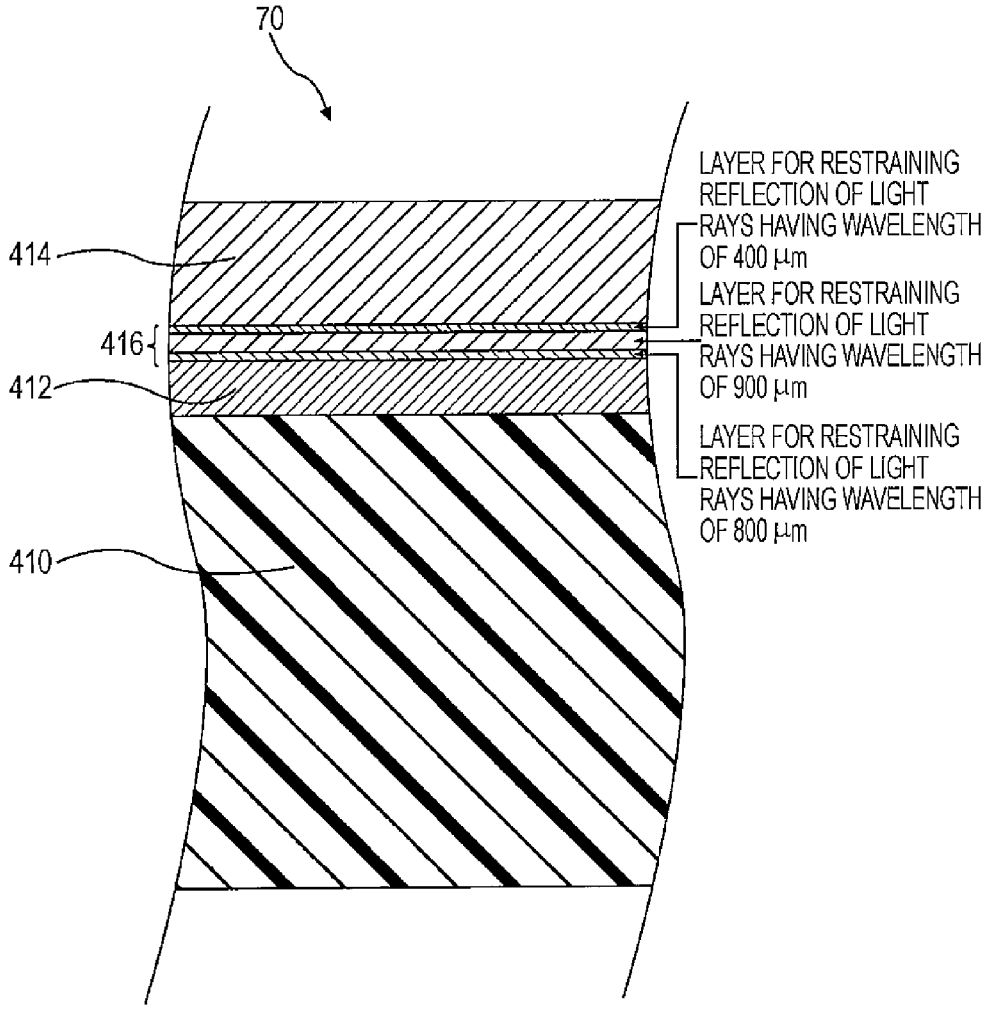
FIG. 6 is a pattern diagram for explaining a structure of the intermediate transfer belt 70 provided with the intermediate layer 416 having a plurality of layers.

Although the thickness d2 of the intermediate layer 416 formed of the antimony trisulfide (Sb2S3) is 104 nm in order to restrain the reflection of the different light rays having the wavelength λ of 800 nm in the description shown above, the intermediate layer 416 can also restrain the reflection of the different light rays having wavelengths in the vicinity of 800 nm to some extent. In addition, when restraint of the reflection of the different light rays having a wavelength apart from 800 nm is desired, the intermediate layer 146 may be formed with a plurality of layers. That is, as shown in FIG. 6, the intermediate layer 416 may be a layer which is formed with a plurality of layers and restrains the reflection from the intermediate transfer belt of the different light rays of a plurality of types having different wavelengths from each other.

In this manner, when the intermediate transfer belt 70 provided in the image forming apparatus includes the intermediate layer 416 described above, when the sensing member 208 senses the reflection of the light rays emitted from the light-emitting member 202 from the intermediate transfer belt 70 (the meal layer 412), the noise is reduced and the sensing accuracy of the sensing member 208 is improved.

Other Embodiments

The image forming apparatus according to the embodiment of the invention has been described thus far. The embodiment described above is illustrative only for facilitating understanding of the invention and is not intended to limit the scope of the invention. Various modifications or alteration may be made without departing from the scope of the invention, and the invention includes the equivalent thereof.

In the embodiment shown above, the full color laser beam printer has been described as the image forming apparatus as an example. However, the embodiment of the invention can be applied to various types of image forming apparatus such as monochrome laser beam printers, copying machines, facsimiles, and so on.

In the description given above, the intermediate transfer belt 70 is provided with the base layer 410 on the side opposite from the intermediate layer 416 when viewed from the metal layer 412. However, the invention is not limited thereto, and the base layer 410 may not be provided.

In the description given above, the sensing member 208 senses the light rays reflected from the intermediate transfer belt 70 and detects the density of the toner image carried on the intermediate transfer belt 70. However, the invention is not limited thereto, and the sensing member 208 may be used for purposes other than the detection of the density of the toner image.

In the description given above, the printer 10 includes the controller (unit controller 102) that adjusts the density of the toner image on the basis of the result sensed by the sensing member 208. That is, in the description given above, the sensing member 208 that senses the density of the toner image is used for the purpose of adjusting the density of the image. However, the invention is not limited thereto, and may be used for other purposes.

Configuration of Image Forming System

Subsequently, referring to the drawings, an example of an image forming system according to the embodiment of the present invention will be described.

Figure 7:
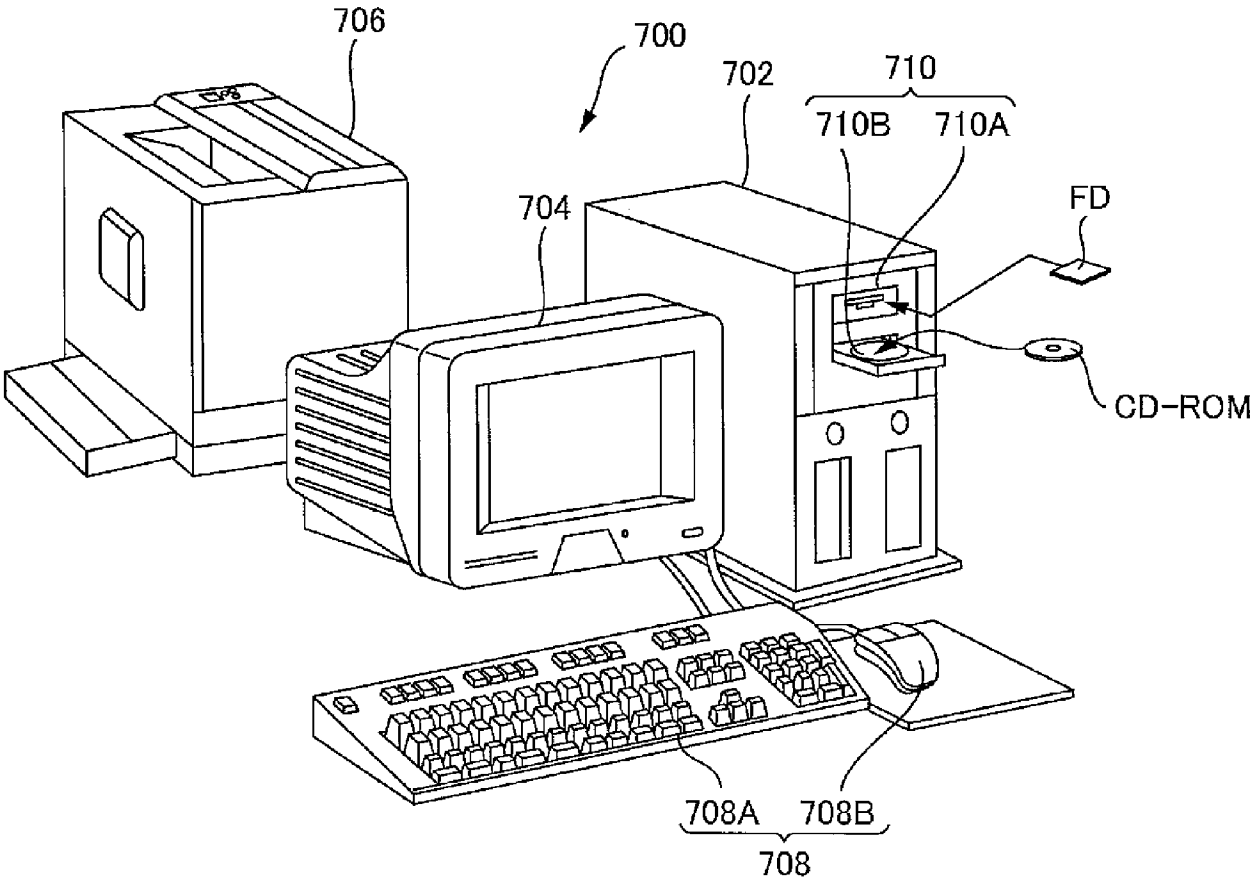
FIG. 7 is an explanatory drawing showing an appearance of an image forming system.

FIG. 7 is an explanatory drawing showing an appearance of the image forming system. The image forming system 700 includes a computer 702, a display device 704, a printer 706, an input device 708 and a reading device 710. The computer 702 in this embodiment is stored in a casing having a mini-tower configuration. However, the invention is not limited thereto The display device 704 is generally selected from the group including CRT (Cathode Ray Tube), plasma display and a liquid crystal display device. However, the invention is not limited thereto. The printer 706 is the printer described above. The input devices 708 in this embodiment are a keyboard 708A and a mouse 708B. However, the invention is not limited thereto. The reading device 710 in this embodiment includes a flexible disk drive device 701A and a CD-ROM drive device 710B. However, the invention is not limited thereto and, for example, it may be of other type, such as MO (Magneto Optical) disk drive device or DVD (Digital Versatile Disk).

Figure 8:
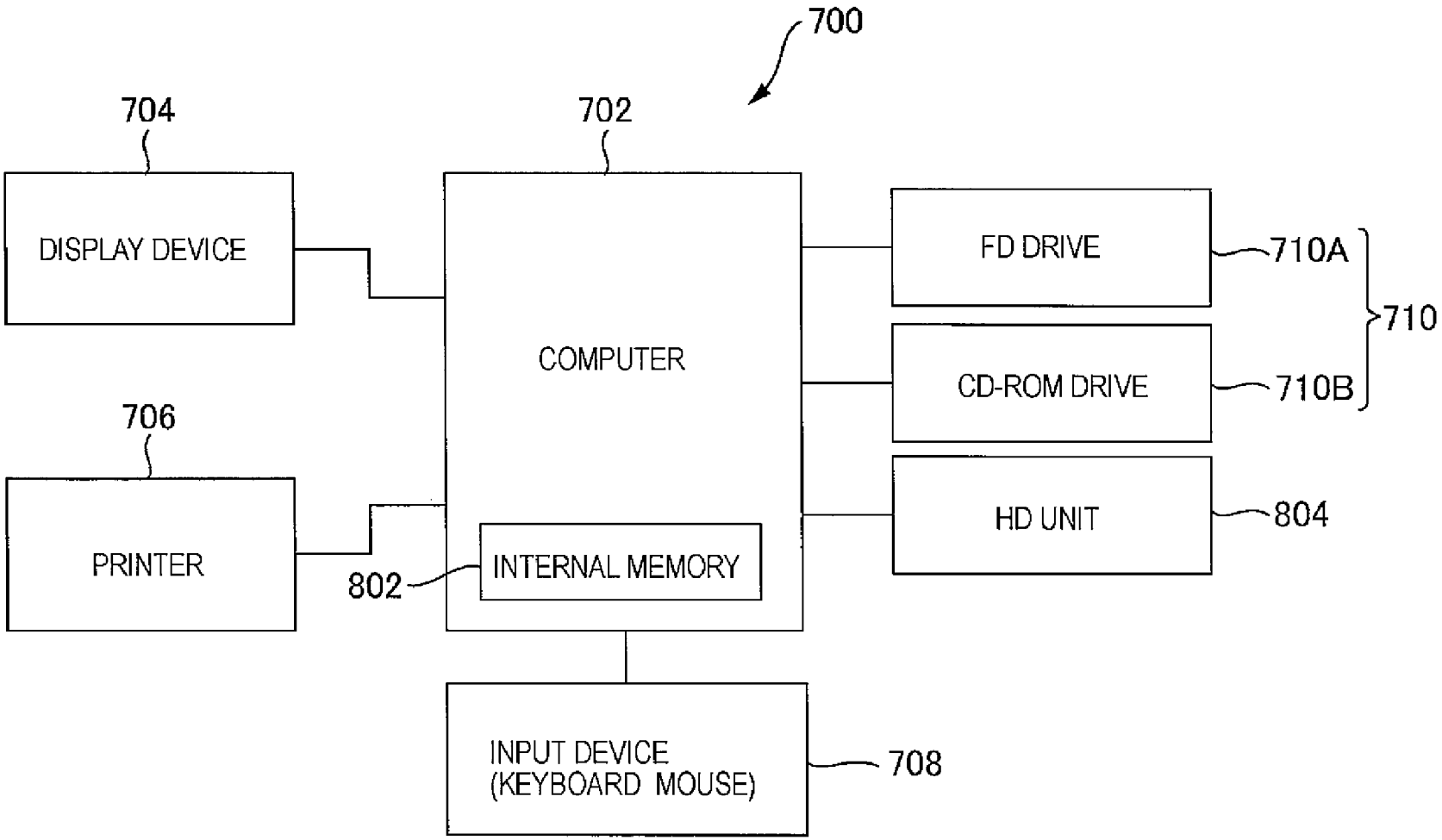
FIG. 8 is a block diagram showing a configuration of the image forming system shown in FIG. 7.

FIG. 8 is a block diagram showing a configuration of the image forming system shown in FIG. 7. There are further provided an internal memory 802 such as RAM in the casing in which the computer 702 is stored, and an external memory such as a hard disk drive unit 804.

In the description shown above, an example of the image forming system in which the printer 706 is connected to the computer 702, the display device 704, the input device 708 and the reading device 710. However, the invention is not limited thereto. For example, the image forming system may be composed of the computer 702 and the printer 706, and the image forming system may not include any one of the display device 704, the input device 708 and the reading device 710.

It is also applicable that the printer 706 includes part of respective functions or the mechanisms of the computer 702, the display device 704, the input device 708 and the reading device 710. For example, the printer 706 may include an image processing unit that performs image processing, a display unit that presents various displays and a recording media attachment unit for attaching and detaching a recording media in which image data photographed by a digital camera or the like is stored.

The image forming system realized in this manner is superior as a whole in comparison with the system in the related art.

What is claimed is:

1. An image forming apparatus comprising:

an exposure unit;

a developing unit;

an intermediate transfer belt having a coated layer as a surface layer that carries an developer image on the surface layer for transferring an image onto a recording material;

a light-emitting member that emits light rays having a predetermined wavelength toward the surface layer of the intermediate transfer belt; and a sensing member that senses the light rays reflected from the intermediate transfer belt, wherein the intermediate transfer belt includes:

a metal layer whose light reflection coefficient is larger than that of the coated layer;

an intermediate layer positioned between the coated layer and the metal layer for restraining the different light rays having a wavelength other than the predetermined wavelength from reflecting from the intermediate transfer belt; and a base layer on a side opposite from the intermediate layer when viewed from the metal layer, and wherein the intermediate layer includes a plurality of layers for restraining the different light rays of a plurality of types having different wavelengths from each other from reflecting from the intermediate transfer belt.

2. The image forming apparatus according to claim 1, wherein the sensing member senses the light rays reflected from the intermediate transfer belt and detect the density of the developer image carried on the intermediate transfer belt.

3. The image forming apparatus according to claim 2, further comprising a controller that controls the density of the image on the basis of the result of detection of the density of the developer image by the sensing member.

* * * * *